US005263294A

United States Patent [19]

Koenig et al.

[11] Patent Number: 5,263,294

[45] Date of Patent: Nov. 23, 1993

[54] EXTENSION JOINT SIMULATING GROUT LIKE FOR TILE BOARD

[75] Inventors: Paul J. Koenig; Douglas F. Hutchings; David W. Gibbard, all of Lapeer; Richard C. Manwell, Millington, all of Mich.

[73] Assignee: Trayco, Inc., Lapeer, Mich.

[21] Appl. No.: 742,978

[22] Filed: Aug. 9, 1991

[51] Int. Cl.[5] ..... E04B 1/38

[52] U.S. Cl. ..... 52/468; 52/471; 52/35; 52/403

[58] Field of Search ..... 52/314, 311, 35, 287, 52/288, 384, 385, 390, 403, 396, 400, 468, 460, 471, 393, 395; 404/53, 64, 68

[56] References Cited

U.S. PATENT DOCUMENTS

| | | | |
|---|---|---|---|
| 1,800,609 | 4/1931 | Drake | 52/314 X |
| 1,975,769 | 10/1934 | Cederholm et al. | 52/387 |
| 2,114,044 | 4/1938 | Bonnell | 52/288 |
| 3,090,087 | 5/1963 | Miller | 52/288 |
| 3,462,900 | 8/1969 | Morrissey | 52/403 X |
| 3,545,154 | 12/1970 | Bobzin et al. | 52/314 X |
| 3,802,142 | 4/1974 | Fehr | 52/314 |
| 4,157,271 | 6/1979 | Moore | 52/288 X |
| 4,299,064 | 11/1981 | Daniels | 52/288 X |
| 4,651,488 | 3/1987 | Nicholas et al. | 52/396 |
| 4,719,732 | 1/1988 | Bernard | 52/287 |
| 5,027,572 | 7/1991 | Purcell et al. | 52/309.9 |
| 5,052,160 | 10/1991 | Gentsch et al. | 52/314 |

FOREIGN PATENT DOCUMENTS

| | | | |
|---|---|---|---|
| 0587195 | 7/1956 | Canada | 52/314 |
| 0314236 | 7/1956 | Switzerland | 52/212 |

*Primary Examiner*—Carl D. Friedman
*Assistant Examiner*—Robert J. Canfield
*Attorney, Agent, or Firm*—Myron B. Kapustij; Malcolm L. Sutherland

[57] ABSTRACT

An extension joint for use with wall boards simulating tiles embedded in grout. The extension joint is disposed between two adjoining wall board panels and simulates a grout line. The wall joint comprises a long narrow strip of material having two spaced apart base sections and a raised ridge section connecting the two base sections. The top outer surface of the ridge section is concave to simulate a grout line.

10 Claims, 2 Drawing Sheets

EXTENSION JOINT SIMULATING GROUT LIKE FOR TILE BOARD

FIELD OF THE INVENTION

This invention relates to an extension joint simulating a grout line for joining together sections or panels of wall board simulating tiles embedded in grout.

BACKGROUND OF THE INVENTION

Tiled walls have long been popular, particularly for bathrooms, kitchens and the like. In spite of the popularity of tiled walls, these walls present certain problems. First, the grout may become a breeding place for stain producing mildew. Once stained the grout is extremely difficult to clean since it is porous and the stain may permeate through the grout. Secondly, the grout may loosen and fall out of the spaces between the tiles. Once the grout is cracked moisture may seep in behind the tiles and loosen them from the supporting wall. In addition, tile is difficult to install in perfectly straight lines. Also, tile is relatively expensive and time consuming to install compared to other walls.

Wall boards or tile boards simulating tiles embedded in grout, such as the one disclosed in application Ser. No. 123,487 filed Nov. 20, 1987, incorporated herein by reference, remedy these problems associated with tiled walls. Such wall boards are finding increased acceptance and usage. These wall boards typically are provided in large sections or panels, e.g. about four feet wide and about four feet high, about four feet wide by eight feet high, etc. When a large area, such as a large wall, is to be covered generally two or more wall board sections or panels are needed. These individual wall board panels are joined in a side-by-side or stacked arrangement, usually in a tile-to-tile arrangement. This joining of the individual wall board panels results in an unsightly seam between adjacent wall board sections. This seam can be eliminated by leaving a space between the adjoining wall board panels and filling this space with grout or caulking material to produce a grout line between the panels. This procedure, however, is time consuming and requires additional effort to insure that the grout or caulking material is worked so as to have a concave surface in order to conform to the simulated grout lines in the wall board panels.

By the use of the extension joint of the instant invention a simulated grout line is created between adjoining wall board panels thereby providing an aesthetically appealing seamless appearance without the necessity of caulking or grouting between adjacent wall board panels.

SUMMARY OF THE INVENTION

The invention is directed to an extension joint adapted to be placed between wall board panels, particularly wall board panels simulating tiles embedded in grout. The extension joint, when placed between two adjoining wall board panels, gives the appearance of or simulates a grout line. The extension joint is a long, narrow structure containing two horizontally extending base sections with a ridge therebetween. The ridge has two vertically extending side walls and a concave top surface. One wall board panel is placed over one of the base sections with its side abutting one side wall of the ridge. The other wall board panel is placed over the other of the base sections with its side abutting the other side wall of the ridge thereby leaving only the concave top surface of the extension joint exposed. The exposed concave top surface of the extension joint disposed between the two wall board sections simulates a grout line; i.e., provides an artificial grout line, thereby giving the appearance that the entire underlying wall or substrate on which the extension joint and wall boards are mounted is covered with tile embedded in grout.

It is to be understood that whenever terms such as horizontally, vertically and the like are used with respect to the base sections and the walls of the ridge, they are used to describe the orientation of such elements as they are illustrated in FIGS. 1-3 and 5 of the drawings.

Actual application of the extension joint may not accurately define or reflect the actual spatial orientation of such elements. Thus, for example, if the extension joint is disposed vertically upon a wall the two base sections will actually extend horizontally while the two side walls of the ridge will extend outwardly from the base sections in a horizontal direction.

DETAILED DESCRIPTION OF THE PREFERRED EMBODIMENTS

Figure 1:
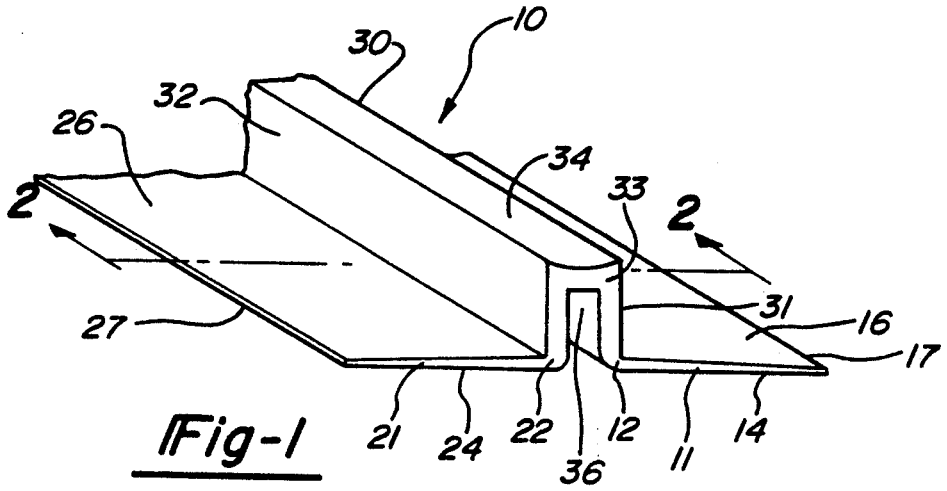
FIG. 1 is a top perspective view of the extension joint of this invention.
Figure 2:
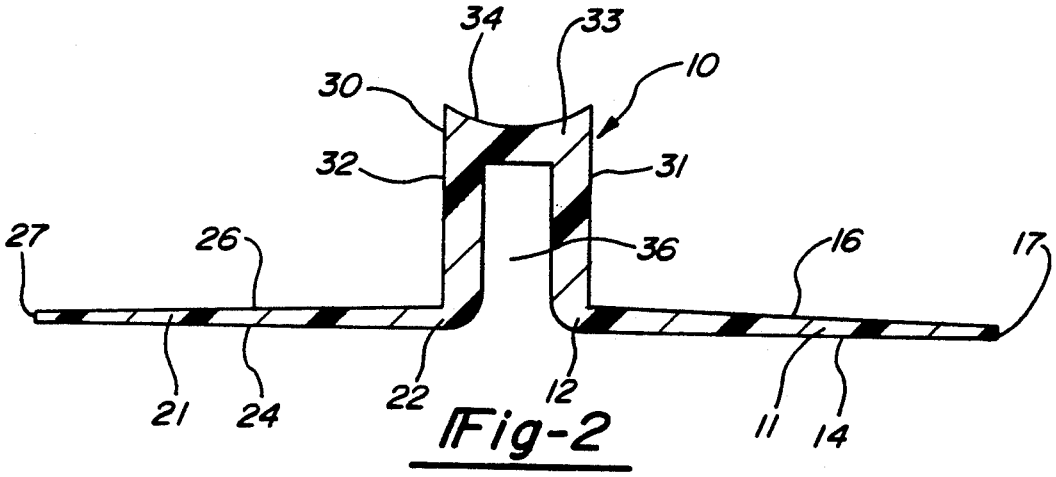
FIG. 2 is a cross-sectional view taken along line 2—2 in FIG. 1.

Referring to FIGS. 1 and 2 the extension joint 10 of the instant invention is a long narrow structure comprised of two horizontally extending base members 11, 21. The two base members 11 and 21 are connected at their inner or central sections 12, 22 to raised central portion or ridge 30. Ridge 30 is comprised of a first side wall 31 extending vertically upward from the inner section 12 of base member 11, and a second side wall 32 extending vertically upward from the inner section 22 of base member 21. A horizontal top section 33 connects side walls 31 and 32. The two side walls 31, 32 and top section 33 define a substantially U-shaped channel 36. As best shown in FIG. 1 both first base member 11, second base member 21, and ridge 30 extend longitudinally.

The outer surface 34 of top section 33 is concave in cross-section to simulate a grout line. In this respect the width of the top section 33 is generally about the same as the width of the simulated grout lines 41, 41' in the wall boards 40, 40'. Preferably this is from about 0.2 inch to about 0.25 inch, e.g., 0.217 inch.

The ridge 30 is integral with the two base members 11, 21.

The base members 11 and 21, as best illustrated in FIGS. 1 and 2, preferably have flat bottom surfaces 14, 24. Bottom surfaces 14 and 24 are next to and in contact with the underlying wall or substrate when the extension joint is mounted on said underlying wall. Base members 11 and 21 also preferably have beveled top surfaces 16, 26 so that they preferably are tapered toward their outer edges 17, 27, being thickest at their inner sections 12, 22 and thinnest at their outer edges 17, 27. Base members 11 and 21 are preferably about 0.01 to about 0.03 inch thick at their outer edges, e.g., 0.015, and from about 0.02 to about 0.05 inch thick at their inner edges, e.g., 0.035. The width of each base member is preferably from about 0.5 to about 0.8 inch; e.g. 0.6 inch.

Figure 5:
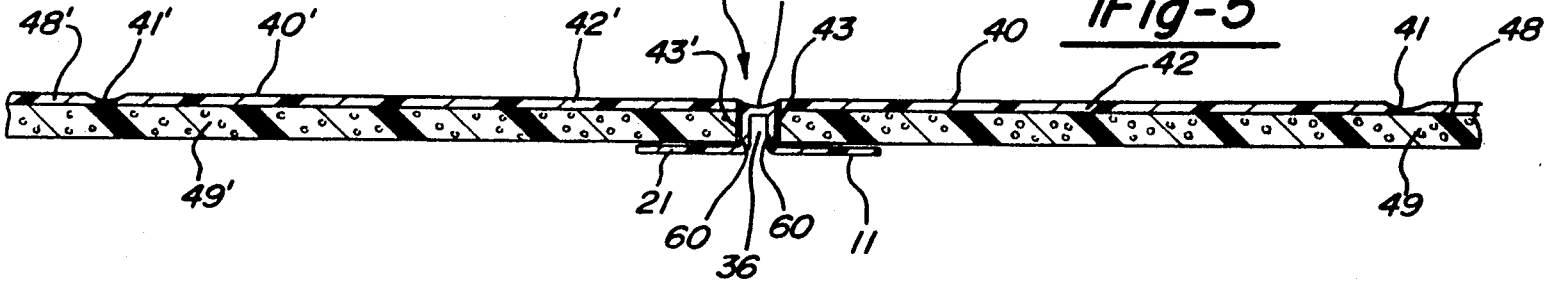
FIG. 5 is a cross-sectional view taken along line 5—5 in FIG. 4.

As best illustrated in FIG. 5 the height of the side walls 31 and 32 is generally about the same as or slightly less than the height or thickness of the wall board panels 40, 40'. The height of the side walls 31 and 32 will thus vary depending upon the thickness of the wall board and may generally range from preferably about 0.03 inch to about 0.5 inch, e.g., 0.310 inch, 0.06 inch. It can be seen from FIG. 5 that when the two wall board panels 40, 40' are placed on top of or overlaid on the base sections 11, 21, the only exposed part of the extension joint 10 is the concave surface 34 of top section 33 of ridge 30. This, together with top section 33 having the concave surface 34 with a width about equal to the width of the simulated grout lines in the wall board panels 40, 40' creates, when the extension joint is disposed intermediate the two wall board panels 40, 40' the appearance of the top section 33 being a grout line. This results in a seamless, one piece appearance of the wall board and extension joint assembly.

The extension joint is comprised of a polymeric thermoplastic material and is preferably made by extrusion, preferably profile extrusion. Polymeric thermoplastic materials useful in extrusion processes are well known to those in the art and are readily commercially available. Some illustrative non-limiting examples of polymeric thermoplastic materials include styrene/acrylonitrile resins; styrene/acrylonitrile/butadiene resin; styrene/butadiene resins; polyolefins such as polyethylene, polypropylene and olefins copolymers and blends, polymethyl methacrylate, polystyrene, polyvinyl chloride, and polyvinylidene chloride.

In one embodiment of the instant invention the extension joints are comprised of profile extruded polystyrene.

The extension joint 10, particularly the top section 33, is of a color which matches the color of the simulated grout lines 41, 41' of the wall board panels 40, 40'. This color is visually distinctive from the color of the simulated tile. Thus, for example, the tiles can be gloss white while the extension joint and simulated grout lines of the wall board are flat white; the tiles can be blue while the extension joint and simulated grout lines are white, etc.

The extension joints are attached to a wall either horizontally, if the wall board sections are to be stacked one on top of the other; vertically, if the wall board sections are to be side-by-side; or some vertically and some horizontally if the wall board panels are to be arranged both stacked and side-by-side. The attachment of the extension joint to the wall is accomplished by any well known and conventional manner, preferably by use of an adhesive which may typically be applied to the bottom surfaces 14 and 24 of the base members 11, 21. Typically the extension joint is attached to the wall, and the wall board sections 40, 40' are then placed over the base members 11, 21 as illustrated in FIG. 5. The sides of the wall board sections 40, 40' are in abutment with the side walls 31, 32 of the ridge 30. As illustrated in the embodiment of FIG. 5 the wall board sections may be optionally adhered to the base members 11, 21 by means of an adhesive 60 or may have caulking compound 60 disposed therebetween. The edges 43, 43' of the wall board 40, 40' are pressed up against the side walls 31, 32 respectively, and any caulking compound that is squeezed out is wiped off from the surface of the wall board and top section 33. The caulking compound 60 insures, inter alia, a water-tight seal between the joint 10 and wall board panels.

The wall board panels 40, 40' may be mounted on the wall by any conventional and well known means. Preferably they are adhered to the wall surface by means of a suitable adhesive.

In the embodiment illustrated in FIGS. 1, 2 and 5 the extension joint is designed to be utilized with the wall board sections 40, 40'. These wall board sections contain top layers 48, 48', which consist of simulated tiles in simulated grout, and backing or bottom layers 49, 49'. The bottom layers 49, 49' are preferably comprised of plastic material, preferably a foamed plastic material, such as for example, polyurethane or any of the thermoplastic materials described above. They may be joined to the bottom surfaces of top layers 48, 48' by any known and conventional means such as, for example, a suitable adhesive.

The top layers 48, 48' may be of any known and conventional type which simulate tiles 42, 42' embedded in grout. The grout lines 41, 41' may be formed by grooves machined or otherwise placed in top surfaces of the top layers 48, 48'. One particularly useful type of tile board is disclosed in U.S. application Ser. No. 123,487, filed Nov. 20, 1987, incorporated herein by reference.

Figure 3:
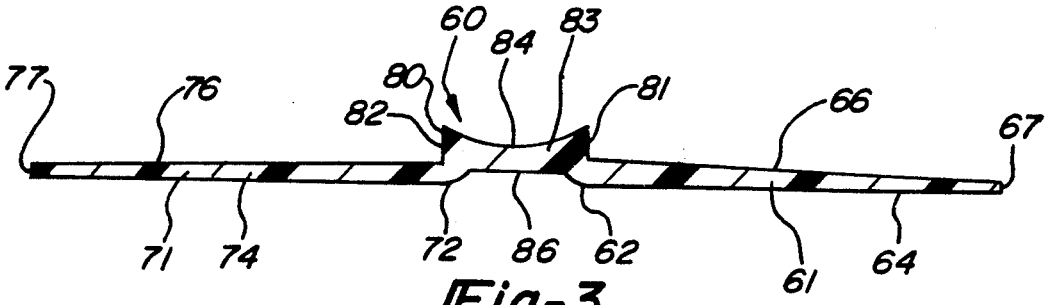
FIG. 3 is a cross-sectional view similar to FIG. 2 except that it shows another embodiment of the extension joint of the invention.
Figure 4:
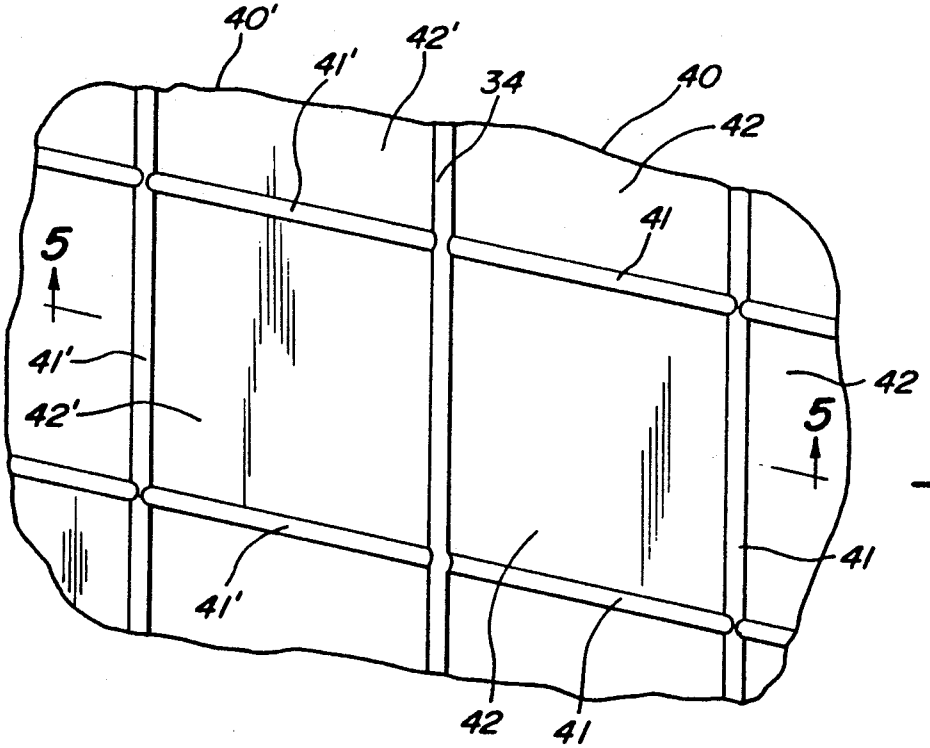
FIG. 4 is a front perspective view of two panels of wall board adjoining each other with the extension joint of FIG. 1 therebetween.

A second embodiment of the instant invention is illustrated in FIG. 3. Extension joint 60 illustrated in FIG. 3 is generally similar to the extension joint 10 illustrated in FIGS. 1 and 2. It contains two horizontally extending base members 61, 71, and a vertically raised ridge 80 joining the two base members 61, 71 at their inner sections 62, 72. The base members 61, 71 preferably have flat bottom surfaces 64, 74 and preferably beveled top surfaces 66, 76 preferably resulting in the base members 61, 71 tapering or narrowing toward their outer edges 67, 77. The ridge 80 is comprised of two vertically extending side walls 81, 82 joined at their top ends by top 83 having a concave outer surface 84.

The difference between extension joint 10 and extension joint 60 is that the side walls 81, 82 of extension joint 60 are shorter than side walls 31, 32 of extension joint 10. Extension joint 80 is intended to be used with wall boards that are thinner than the wall boards used with extension joint 10. For example, extension joint 80 can be used with wall boards 40, 40' that contain only the top layers 42, 42'; i.e., they do not contain bottom layers 49, 49'.

The extension joints are typically provided in lengths of from about 5 to about 8 feet. The width of the extension joints is preferably from about 1.0 to about 2 inches, more preferably from about 1.2 to about 1.6 inches, e.g., 1.45 inches.

The extension joints are particularly useful in bathroom surrounds, bathtub surrounds, and shower surrounds.

This invention may be further developed within the scope of the following claims. Accordingly, the above specification is to be interpreted as illustrative of only a single operative embodiment of the present invention, rather than in a strictly limited sense.

What is claimed is:

1. A long, narrow extension joint for use with wall boards simulating tiles embedded in grout comprising:

a first horizontal base section;

a second horizontal base section spaced from said first base section; and a raised central section connecting said first and second base sections, said raised central section comprised of two vertically extending side walls which are substantially perpendicular to said base sections and a top wall having an outer surface connecting said two side walls, with the outer surface of said top wall being concave and rounded and simulating a grout line.

2. The extension joint of claim 1 wherein said base sections have a flat bottom surface.

3. The extension joint of claim 2 wherein said base sections have beveled upper surfaces.

4. The extension joint of claim 3 wherein said base sections have outer edges and taper outwardly being thickest adjacent said central section and thinnest at their outer edges.

5. The extension joint of claim 1 wherein said joint is comprised of plastic.

6. The extension joint of claim 5 wherein said plastic is thermoplastic.

7. A wall board panel assembly simulating tiles embedded in grout comprising at least two wall board panels mounted adjacent each other in a side-by-side but spaced apart relationship on a supporting wall with at least one edge of each panel being adjacent one edge of the next adjacent panel, said panels simulating tiles embedded in grout;

long, narrow joint member having a pair of outwardly extending base sections each one of which base sections is disposed between different adjacent board panels and said supporting wall, said joint member having a central raised section connecting said base sections comprised of two side walls and top wall having an outer surface connecting said side walls, with the outer surface of said top wall being concave and rounded and simulating a grout line;

said raised portion of said joint member being disposed between said adjacent edges of said board panels, with said concave and rounded outer surface of said top wall simulating a grout line.

8. The assembly according to claim 7 wherein said side walls are substantially perpendicular to said outwardly extending base sections.

9. The assembly according to claim 7 wherein the depth and width of said concave top wall is similar to the depth and width of the simulated grout lines in said wall board panels.

10. The assembly according to claim 9 wherein said wall board panels and said joint member are comprised of plastic.

* * * * *